US012593923B1

(12) United States Patent
Lo

(10) Patent No.: US 12,593,923 B1
(45) Date of Patent: Apr. 7, 2026

(54) ROBUST HINGE OF A COLLAPSIBLE BED

(71) Applicant: TUNG KENG ENTERPRISE CO., LTD., Taichung (TW)

(72) Inventor: Chiu-Hsiang Lo, Taichung (TW)

( * ) Notice: Subject to any disclaimer, the term of this patent is extended or adjusted under 35 U.S.C. 154(b) by 0 days.

(21) Appl. No.: 19/023,344

(22) Filed: Jan. 16, 2025

(51) Int. Cl.
*A47C 19/12* (2006.01)

(52) U.S. Cl.
CPC ..... *A47C 19/122* (2013.01)

(58) Field of Classification Search
None
See application file for complete search history.

(56) References Cited

U.S. PATENT DOCUMENTS 5,906,029 A * 5/1999 Fox ..... E05D 5/12 16/221
7,096,536 B2 * 8/2006 Johnson ..... E05D 11/1085 16/334
12,473,765 B2 * 11/2025 Mason ..... E05D 15/165

* cited by examiner

*Primary Examiner* — Adam C Ortiz
(74) *Attorney, Agent, or Firm* — Bruce Stone LLP; Joseph A. Bruce

(57) ABSTRACT

A collapsible bed includes a frame and a hinge. The frame includes a longitudinal rod and a crossbar. The hinge includes two connecting pieces, a threaded bolt and a nut. The first connecting piece is connected to the crossbar and includes an intermediate section formed between two lugs and two protuberances extending from the lugs. The second connecting piece is connected to the longitudinal rod and includes a middle section formed between two ears. The second connecting piece spans the longitudinal rod. The ears are placed between the lugs. The threaded bolt extends through the lugs and the ears. The nut is engaged with the threaded bolt so that the longitudinal bar is pivotally connected to the crossbar.

7 Claims, 5 Drawing Sheets

ROBUST HINGE OF A COLLAPSIBLE BED

BACKGROUND OF INVENTION

1. Field of Invention

The present invention relates to a collapsible bed and, more particularly, to a robust hinge for a collapsible bed.

2. Related Prior Art

A collapsible frame of a bed includes multiple hinges for interconnecting two sub-frames. Thus, the sub-frames are pivotable relative to each other.

Referring to FIG. 6, a conventional hinge 90 includes two connecting pieces each of which includes a lug 95 extending from a tab 96 at the right angle. Each of the tabs 96 is connected to a corresponding one of the sub-frames by welding. The lugs 95 are pivotally connected to each by a threaded bolt 91 engaged with a nut 92. In operation, the sub-frames are inevitably subjected to vibration, which tends to enlarge the distance between the lugs 95 and loosen the threaded bolt 91 from the nut 92. In the worst scenario, the nut 92 is disengaged from the threaded bolt 91 so that the lugs 95 are separated from each other and that the sub-frames are separated from each other.

The hinge 90 further includes a spacer 94 in the form of a washer between the lugs 95, a washer 93 located between a head of the threaded bolt 91 and one of the lugs 95, and another washer 93 located between the nut 92 and the other lug 95. The washers 93 and the spacer 94 are used to buffer vibration of the sub-frames. However, the use of the washers 93 and the spacer 94 keeps the threaded bolt 91 engaged with the nut 92. However, the vibration imposed on the sub-frames can deform the connecting pieces such as twisting the lugs 95 relative to the tabs 96. Such deformation of connecting pieces renders the pivoting of the sub-frames relative to each other unsmooth.

Therefore, the present invention is intended to obviate or at least alleviate the problems encountered in the prior art.

SUMMARY OF INVENTION

It is the primary objective of the present invention to provide a collapsible frame of a bed with a robust hinge.

To achieve the foregoing objective, the hinge includes two connecting pieces, a threaded bolt and a nut. The first connecting piece is connected to a crossbar of a frame of the bed and includes an intermediate section formed between two lugs and two protuberances extending from the lugs. The second connecting piece is connected to a longitudinal rod of the frame of the bed and includes a middle section formed between two ears. The second connecting piece spans the longitudinal rod. The ears are placed between the lugs. The threaded bolt extends through the lugs and the ears. The nut is engaged with the threaded bolt so that the longitudinal bar is pivotally connected to the crossbar.

Other objectives, advantages and features of the present invention will be apparent from the following description referring to the attached drawings.

BRIEF DESCRIPTION OF DRAWINGS

The present invention will be described via detailed illustration of the preferred embodiment referring to the drawings wherein.

DETAILED DESCRIPTION OF PREFERRED EMBODIMENT

Figure 1:
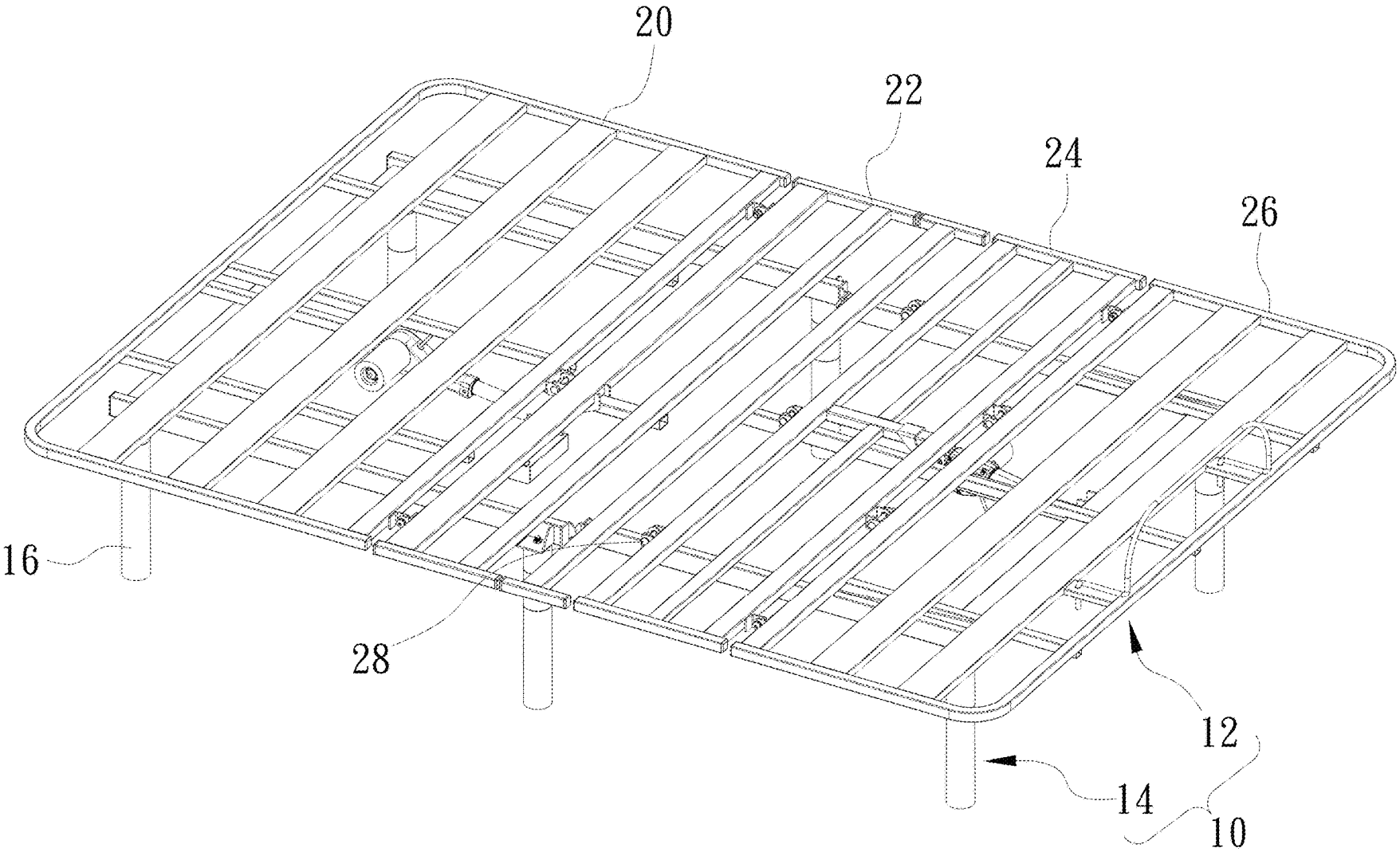
FIG. 1 is a perspective view of a collapsible frame of a bed equipped with multiple hinges according to the preferred embodiment of the present invention.
Figure 2:
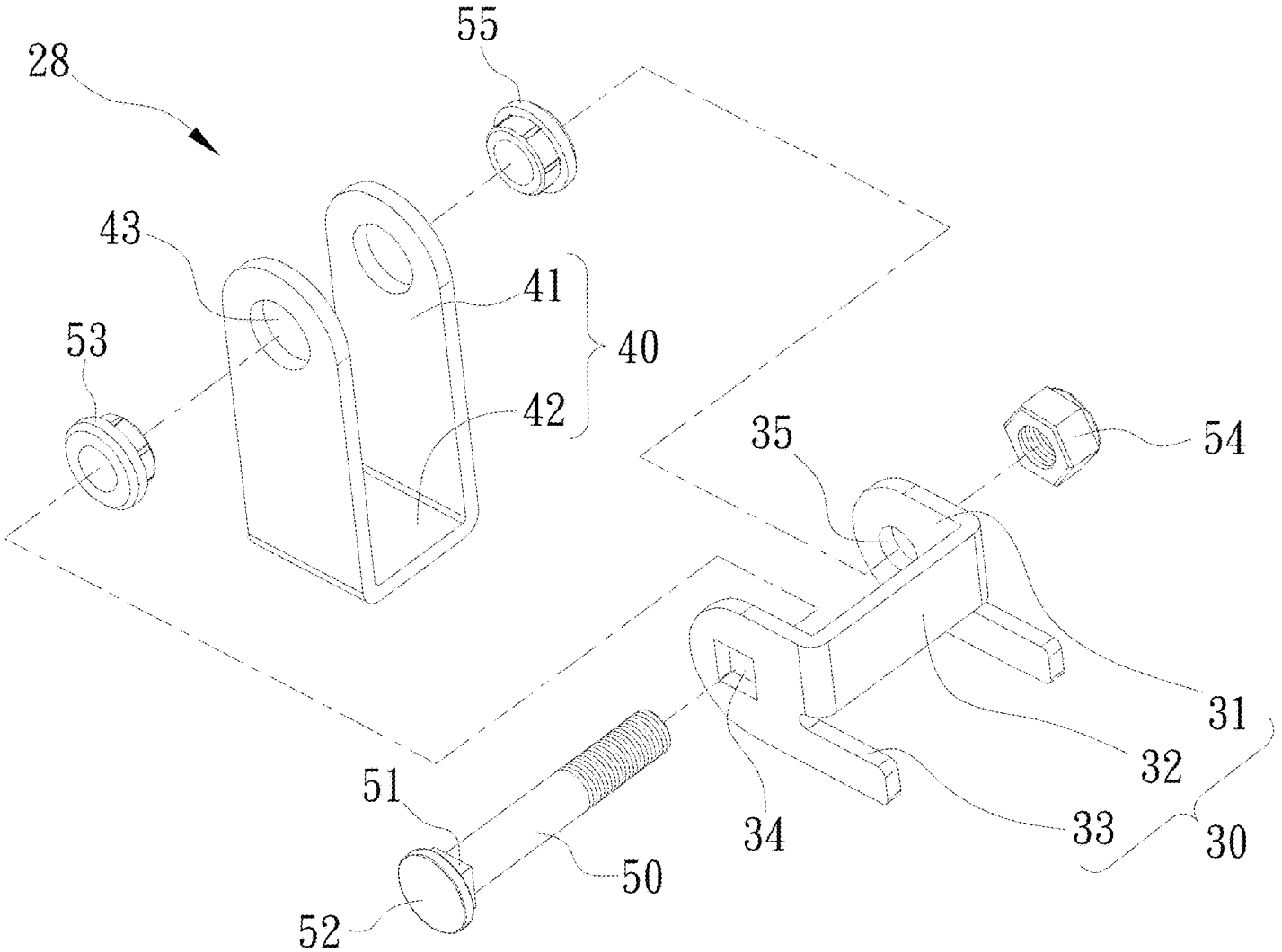
FIG. 2 is an exploded view of one of the hinges shown in FIG. 1.
Figure 3:
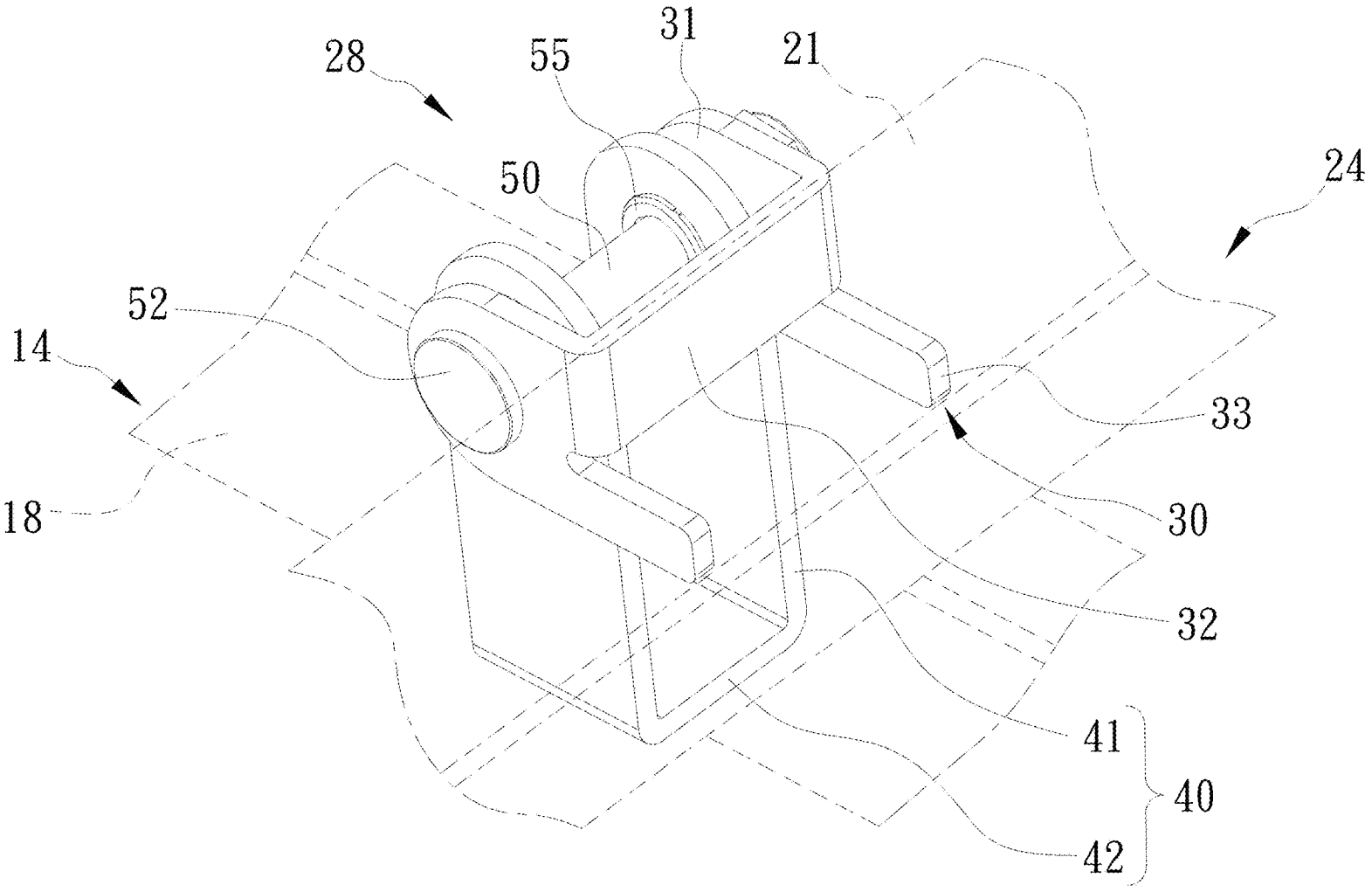
FIG. 3 is a perspective view of the hinge shown in FIG. 2.

Referring to FIG. 1, a bed 10 includes a collapsible frame 12 on a base 14. The base 14 includes multiple legs 16 in contact with a floor for example.

The collapsible frame 12 includes sub-frames 20, 22, 24 and 26. Multiple hinges 28 interconnect any two adjacent of the sub-frames 20, 22, 24 and 26 so that they are pivotable relative to each other.

A telescopic mechanism (not numbered) is used for the collapsible frame 12. The telescopic mechanism is used to move the collapsible frame 12 between an extended position and a collapsed position. In the collapsed position, the sub-frames 20, 22, 24 and 26 are overlapped.

Referring to FIGS. 2 through 5, only one of the hinges 28 will be described in detail and referred to as "the hinge 28." The hinge 28 includes a connecting piece 30, a connecting piece 40, a threaded bolt 50, two flanged bushings 53 and 55, and a nut 54.

The connecting piece 30 includes two lugs 31 extending from an intermediate section 32 at the right angle and two protuberances 33 extending from the lugs 31. The lugs 31 extend on a side of the intermediate section 32. The protuberances 33 extend on an opposite side of the intermediate section 32. Thus, the connecting piece 30 resembles an "H." Width of the intermediate section 32 is smaller than width of the lugs 31. Width of the protuberances 33 is smaller than the width of the intermediate section 32. One of the lugs 31 includes a square orifice 34. The other lug 31 includes a circular orifice 35 aligned to the square orifice 34.

The connecting piece 30 is connected to a crossbar 21 of the sub-frame 24 by welding for example. In specific, the hinge 32 and/or the protuberances 33 are connected to the crossbar 21. Thus, the rigidity of the connecting piece 30 during use is enhanced.

The connecting piece 40 includes two ears 41 extending from a middle section 42 at the right angle. The middle section 42 of the connecting piece 40 is shorter than the hinge part 32. The distance between the ears 41 is shorter than the distance between the lugs 31. Each of the ears 41 includes an aperture 43. The apertures 43 are aligned with each other.

In use, the connecting piece 40 spans a longitudinal rod 18 of the base 14 before the ears 41 and/or the middle section 42 are connected to the longitudinal rod 18 by welding for example. Thus, the rigidity of the connecting piece 40 is enhanced.

In assembly, the ears 41 are placed between the lugs 31. The flanged bushing 53 is inserted into the aperture 43 of one of the ears 41. The flanged bushing 53 includes a flange (not numbered) extending between the ear 41 and the lug 31 that is made with the square orifice 34. The flanged bushing 55 is inserted in the aperture 43 of the other ear 41. The flanged bushing 55 includes a flange (not numbered) extending between the ear 41 and the lug 31 that is made with the circular orifice 35.

The threaded bolt 50 includes a square section 51 between a head 52 and a threaded section (not numbered). The diameter of the threaded section of the threaded bolt 50 is smaller than the diagonal of the square section 51, and the diagonal of the square section 51 is smaller than the diameter of the head 52.

The threaded section of the threaded bolt 50 extends out of the circular orifice 35 via the square orifice 34, the flanged bushing 53, the apertures 43 and the flanged bushing 55. The square section 51 is inserted in the square orifice 34 to prevent the threaded bolt 50 from rotation as the nut 54 is engaged with the threaded section of the threaded bolt 50. The flanges of the flanged bushings 53 and 55 are used as washers for buffering vibration of the base 14 and the sub-frame 24 which might otherwise loosen the nut 54 from the threaded section of the threaded bolt. That is, the engagement of threaded bolt 50 with the threaded bolt 50 is secured to ensure proper operation of the hinge 28.

Figure 5:
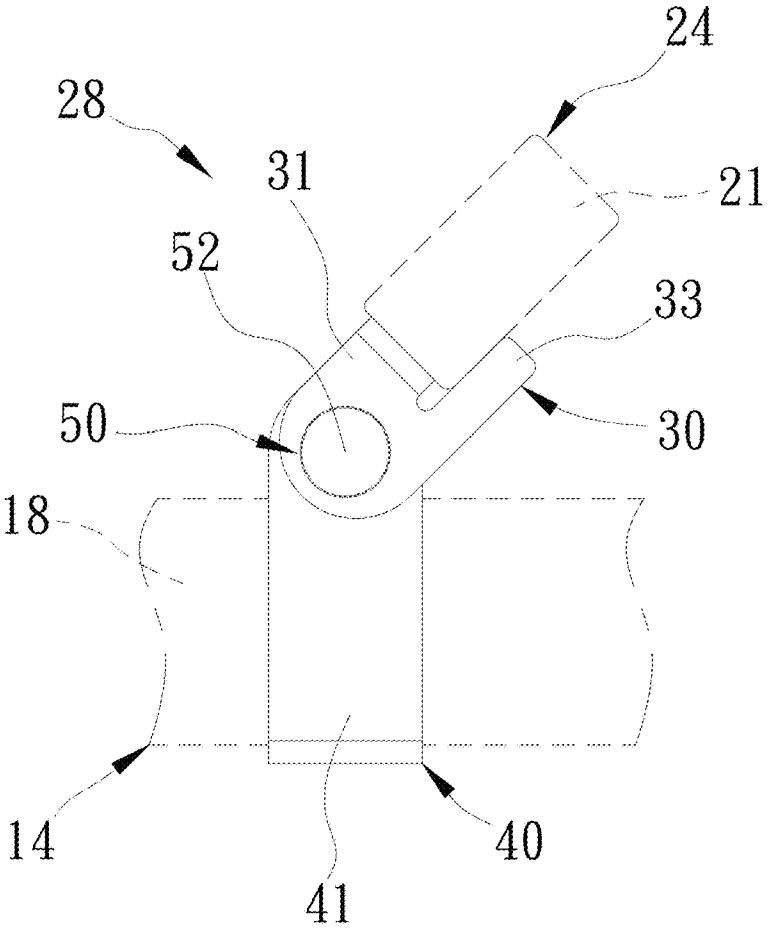
FIG. 5 is a front view of the hinge in another position than depicted in FIG. 4.
Figure 4:
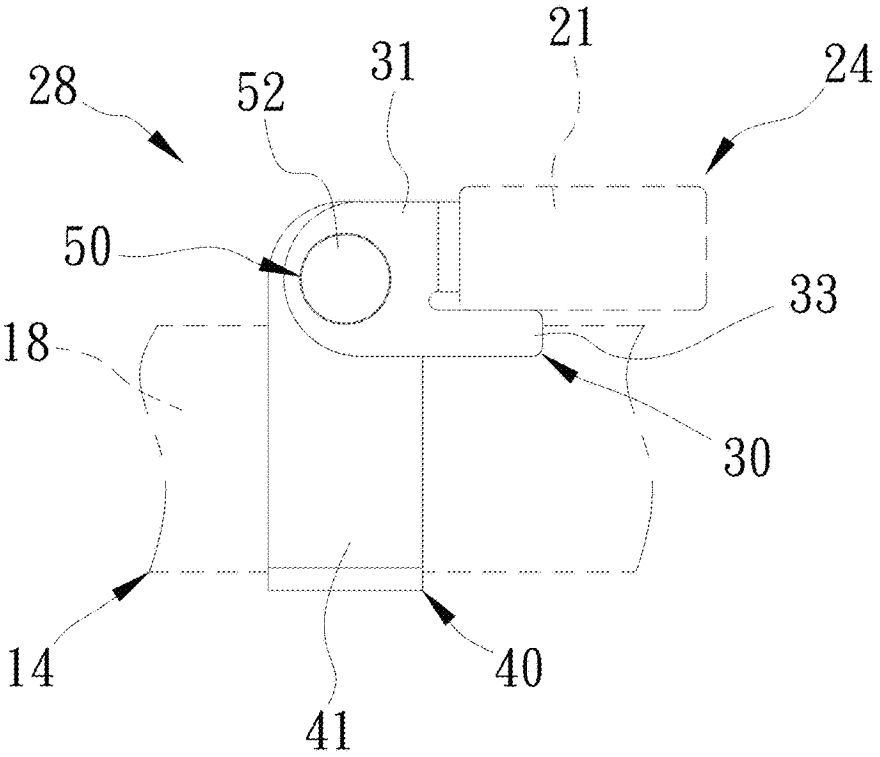
FIG. 4 is a front view of the hinge shown in FIG. 3.
Figure 6:
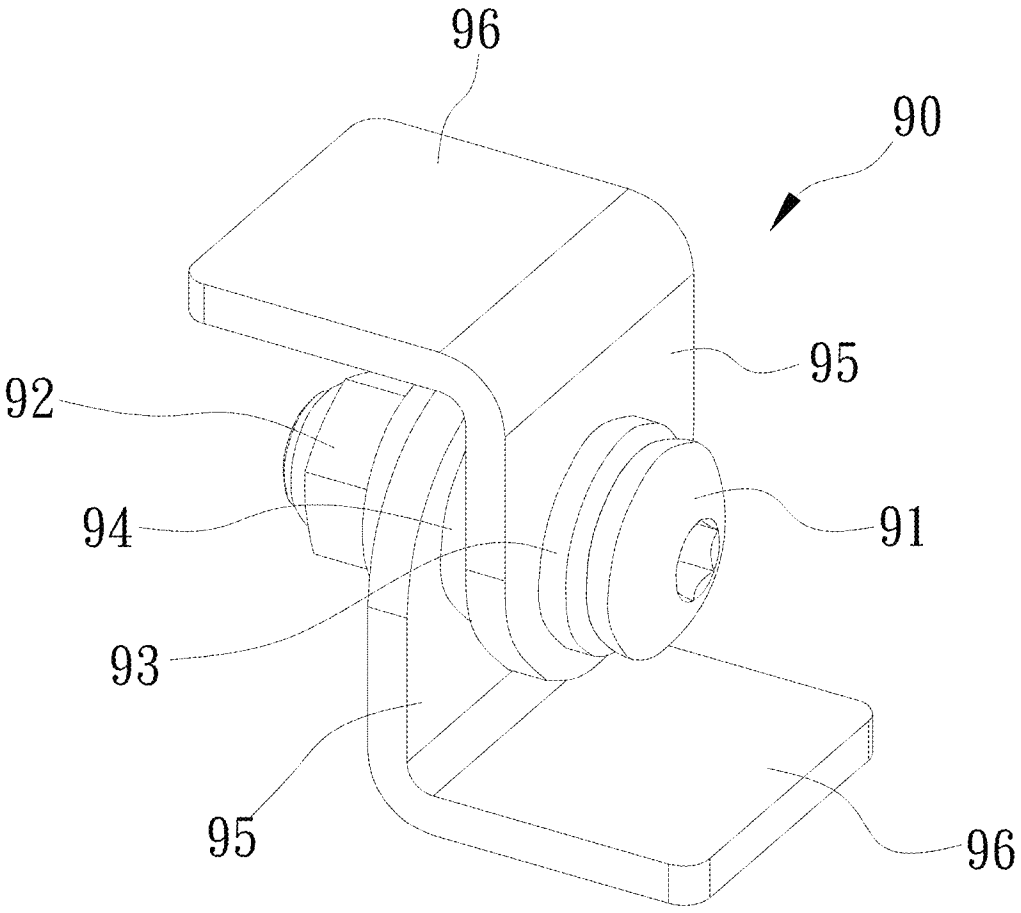
Fig. 6(Prior Art)
FIG. 6 is a perspective view of a conventional hinge.

Referring to FIGS. 4 and 5, the use of the hinge 28 renders the pivoting of thigh sub-frame 24 relative to the base 14 smooth.

The simple structure of the hinge 28 in combination with the longitudinal rod 18 and the crossbar 21 improves the smoothness of the pivot of the sub-frame 24 relative to the base 14. That is, the smoothness in the operation of the bed 10 is improved.

The present invention has been described via the illustration of the preferred embodiment. Those skilled in the art can derive variations from the preferred embodiment without departing from the scope of the present invention. Therefore, the preferred embodiment shall not limit the scope of the present invention defined in the claims.

The invention claimed is:

1. A collapsible bed comprising a frame and a hinge, wherein the frame comprises a longitudinal rod and a crossbar wherein the hinge comprises:

a first connecting piece connected to the crossbar, wherein the first connecting piece comprises two lugs, an intermediate section formed between the lugs, and two protuberances extending from the lugs;

a second connecting piece connected to the longitudinal rod, wherein the second connecting piece comprises two ears and a middle section formed between the ears, wherein the second connecting piece spans the longitudinal rod, wherein the ears are placed between the lugs;

a threaded bolt extending through the lugs and the ears; and a nut engaged with the threaded bolt so that the longitudinal bar is pivotally connected to the crossbar.

2. The collapsible bed according to claim 1, wherein one of the lugs comprises square orifice, wherein the threaded bolt comprises a square section inserted in the square orifice, thereby rendering the threaded bolt not rotatable relative to the first connecting piece.

3. The collapsible bed according to claim 1, comprising two flanged bushings each of which comprises a flange, wherein the flanged bushings receive the threaded bolt and are inserted in the ears, wherein the flange of each of the flanged bushings is located between a corresponding one of the lugs and a corresponding one of the ears.

4. The collapsible bed according to claim 1, wherein the protuberances are connected to the crossbars.

5. The collapsible bed according to claim 1, wherein the intermediate section is connected to the crossbars.

6. The collapsible bed according to claim 1, wherein the cars are connected to the longitudinal rod.

7. The collapsible bed according to claim 1, wherein the middle section is connected to the longitudinal rod.

* * * * *